US010894678B2

(12) United States Patent
Nameroff et al.

(10) Patent No.: US 10,894,678 B2
(45) Date of Patent: Jan. 19, 2021

(54) PICK ARM RAISE WITH ONE-WAY CLUTCH AND TORQUE LIMITER

(71) Applicant: Hewlett-Packard Development Company, L.P., Spring, TX (US)

(72) Inventors: Alexander M Nameroff, Vancouver, WA (US); Devin S Uehling, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 65 days.

(21) Appl. No.: 16/330,825

(22) PCT Filed: Sep. 7, 2016

(86) PCT No.: PCT/US2016/050502
§ 371 (c)(1),
(2) Date: Mar. 6, 2019

(87) PCT Pub. No.: WO2018/048391
PCT Pub. Date: Mar. 15, 2018

(65) Prior Publication Data
US 2019/0196386 A1 Jun. 27, 2019

(51) Int. Cl.
*B65H 3/06* (2006.01)

(52) U.S. Cl.
CPC ..... *B65H 3/0684* (2013.01); *B65H 3/0669* (2013.01); *B65H 2403/72* (2013.01); *B65H 2403/732* (2013.01); *B65H 2403/942* (2013.01)

(58) Field of Classification Search
CPC ..... B65H 3/0684; B65H 3/0669; B65H 2403/942; B65H 2403/72; B65H 2403/732
See application file for complete search history.

(56) References Cited

U.S. PATENT DOCUMENTS 5,085,420 A * 2/1992 Sata ..... B65H 3/0669 271/114
5,203,552 A 4/1993 Hoshi et al.
5,624,109 A 4/1997 Tanaka
5,755,435 A * 5/1998 Fujiwara ..... H04N 1/00567 271/10.04

(Continued)

FOREIGN PATENT DOCUMENTS

CN 102009864 4/2011
CN 102807113 12/2012
JP 2014004800 A 5/2014

*Primary Examiner* — Jeremy R Severson
(74) *Attorney, Agent, or Firm* — HP Inc. Patent Department

(57) ABSTRACT

A media drive may include a media drive member, a shaft, a pick arm rotationally supporting the media drive member and a transmission operably coupling the shaft and the media drive member such that rotation of the shaft in a first direction drives the media drive member. A one-way clutch may be coupled to the shaft so as to be operably disengaged from the shaft in response to the shaft rotating in the first direction, wherein the one-way clutch is to rotate with the shaft in response to the shaft being rotated in a second direction opposite the first direction. A torque limiter may be connected to the one-way clutch to rotate with the one-way clutch, wherein the torque limiter is coupled to the pick arm to pivot the pick arm and the media drive member in response to the shaft being rotated in the second direction.

15 Claims, 8 Drawing Sheets

(56) References Cited

U.S. PATENT DOCUMENTS

| | | | | |
|---|---|---|---|---|
| 6,352,256 | B1 | 3/2002 | Hsieh | |
| 7,398,970 | B2 | 7/2008 | Morimoto et al. | |
| 7,594,652 | B2 | 9/2009 | Schalk et al. | |
| 9,056,734 | B2 | 6/2015 | Gaarder et al. | |
| 10,093,497 | B2 * | 10/2018 | Zensai | B65H 3/0684 |
| 2007/0290430 | A1 | 12/2007 | Lee | |

* cited by examiner

PICK ARM RAISE WITH ONE-WAY CLUTCH AND TORQUE LIMITER

BACKGROUND

Printers, copiers, scanners and other media handling devices often include a pick arm that moves a media drive member, such as a pick tire or belt, into and out of engagement with a top sheet of a stack of media in a tray. Raising the media drive member out of engagement with a stack of media allows the stack to be replenished. When the media drive member is lowered, the media drive member may be driven to separate and move the topmost sheet of the stack of media further along the media path of the printer or other media handling device.

DETAILED DESCRIPTION OF EXAMPLES

Many existing media handling devices, such as printers, copiers, scanners and the like, utilize complex space consuming media drive mechanisms to lift and pick individual sheets of media in a tray. The present disclosure describes a media drive that utilizes a one-way clutch and a torque limiter to raise a media drive member, such as a pick tire, simply in response to the same shaft that drives the pick tire being rotated in a reverse direction. As a result, the media drive facilitates more compact and less costly media handling devices.

Figure 1:
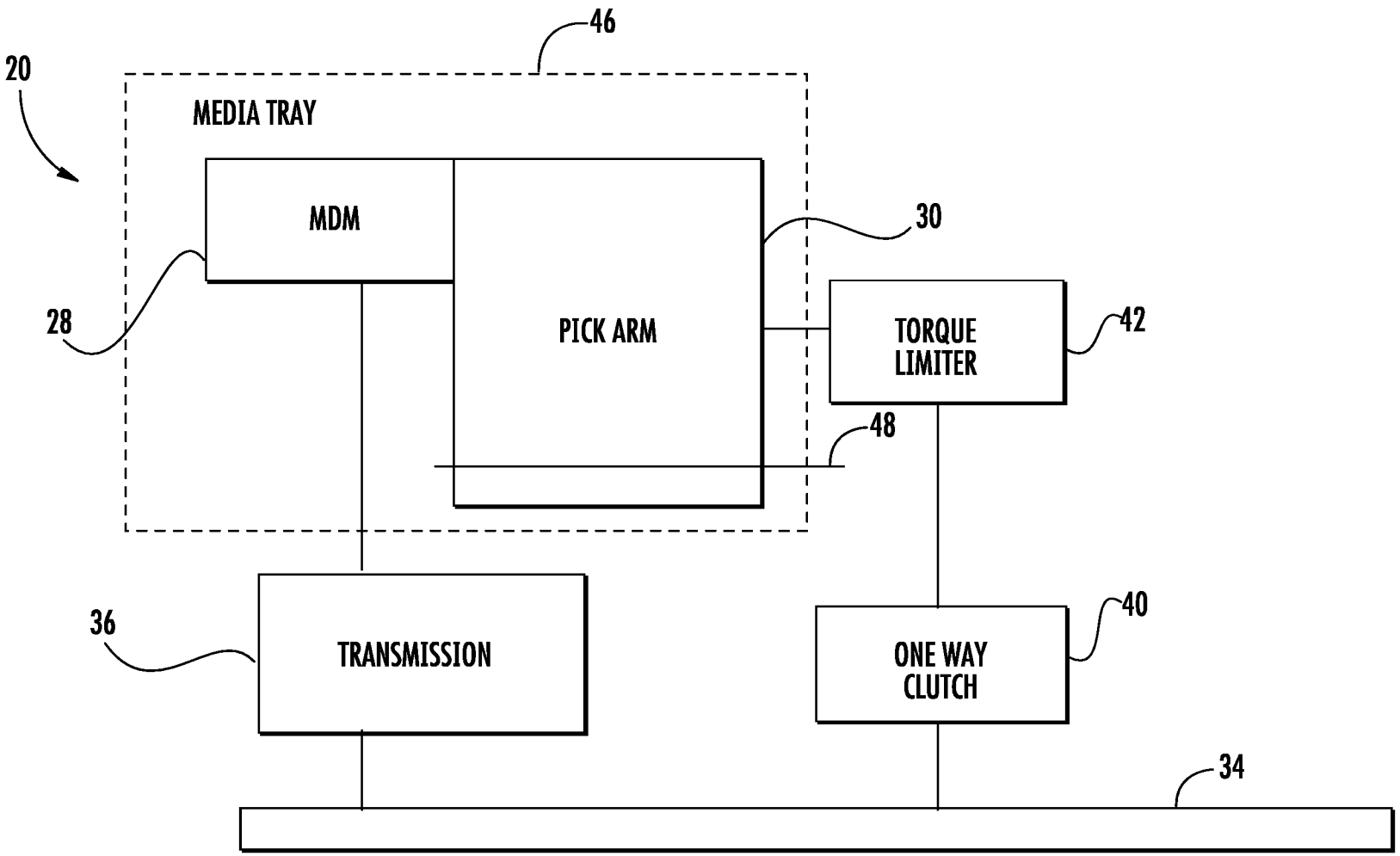
FIG. 1 is a schematic diagram of an example media drive.

FIG. 1 schematically illustrates an example media drive 20. Media drive 20 lifts or picks individual sheets of media from a media tray 46 and drives or moves the individual picked and separated sheets of media further along a media path to a media handling element that performs operations on the individual sheet. Examples of different media handling elements include printing elements, image scanning elements and perforating or creasing elements. Media drive 20 has relatively few parts and occupies relatively little space.

Media drive 20 comprises media drive member 28, pick arm 30, shaft 34, transmission 36, one-way clutch 40 and torque limiter 42. Media drive member 28 comprises a member to be driven while in contact with a topmost or front-most sheet, such as a paper sheet, of a stack of media in media tray 46. Media drive member 28 may grip the sheet of paper or frictionally contact the sheet of paper while being driven. To facilitate loading or unloading of media tray 46, media drive member 28 may be lifted or raised out of contact with the stack of media in media tray 46. In one implementation, media drive member 28 comprises a pick tire, a tubular or cylindrical member, such as a roller, having a rubber or rubber-like outer circumferential surface that is to be rotatably driven in at least one direction while in contact with media. In another implementation, media drive member 28 may comprise a belt or other media gripping surface which is driven or rotated about multiple axes while in contact with the media.

Pick arm 30 comprises a structure that movably supports media drive member 28 relative to the media within media tray 46. Pick arm 30 pivotably supports media drive member 28 for movement between the media engaging and driving position and a media disengaged position. Pick arm 30 is pivotally supported by housing, frame or other structure about axis 48.

Shaft 34 comprises a shaft operably coupled to a source of torque, such as a motor, so as to be rotatably driven and so as to transmit torque to transmission 36 and to one-way clutch 40, depending upon the direction of rotation of shaft 34. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Shaft 34 is rotatably supported by housing or other structure of the media handling device employing media drive 20. In one implementation, shaft 34 is coextensive with axis 48, providing the axis about which pick arm 30 pivots. In another implementation, shaft 34 may be spaced from and distinct from the axis 48 about which pick arm 30 pivots.

Transmission 36 comprises a drivetrain or powertrain by which torque from shaft 34 is transmitted to media drive member 28 to drive a rotate media drive member 28. Transmission 36 may comprise a gear train, chain and sprocket arrangement, a belt and pulley arrangement or combinations thereof. In one implementation, transmission 36 is supported or carried by pick arm 30. In other implementations, transmission 36 may be supported independent of pick arm 30.

One-way clutch 40 and torque limiter 42 cooperate to form a lift mechanism to raise pick arm 30 and media drive member 28 from a media driving and engaging state or position to a raised pick arm, media disengaged state or position. One-way clutch 40 comprises a clutch mechanism coupled to shaft 34 that automatically actuates between a shaft engaged and a shaft disengaged state depending upon the direction in which shaft 34 is being rotatably driven. One-way clutch 40 is operably disengaged from shaft 34 in response to shaft 34 rotating in a first forward or media picking direction that drives media drive member 28 in a driven direction that moves the engaged sheet of media towards and further along the media path. One-way clutch 40 automatically engages shaft 34 so as to rotate with shaft 34, in response to shaft 34 being rotated in a second reverse direction. Examples of one-way clutch 40 include, but are not limited to, a needle bearing one-way clutch.

Torque limiter 42 comprises a mechanism that limits the amount of torque, the magnitude of torque, being transmitted. Torque limiter 42 is operably coupled between one-way clutch 40 and pick arm 30. In one implementation, torque limiter 42 limits torque by slipping, as in a friction plate slip-clutch. In one implementation, torque limiter 42 comprises a first portion fixed or directly connected to pick arm 30 and a second portion fixed or otherwise directly connected to one-way clutch 40, wherein the two portions are in frictional contact with one another so as to move with one another (without slippage) and transmits torque there between or so as to slip relative to one another, reducing or completely discontinuing the amount of torque being transmitted between the two portions. In the example illustrated, torque limiter 42 transmits torque (without slipping) from one-way clutch 40 to pick arm 30 while pick arm 30 is being raised and is moving. Torque limiter 42 slips or discontinues the transmission of torque from one-way clutch 40 to pick arm 30 automatically in response to pick arm 30 encountering an obstruction or stop that limits any further upwards movement or upward pivoting of pick arm 30. Torque limiter 42 allows the source of torque, such as a motor, to continue running and to continue to supply torque to shaft 34 without stalling after pick arm 30 hits its rotation stop.

Figure 2:
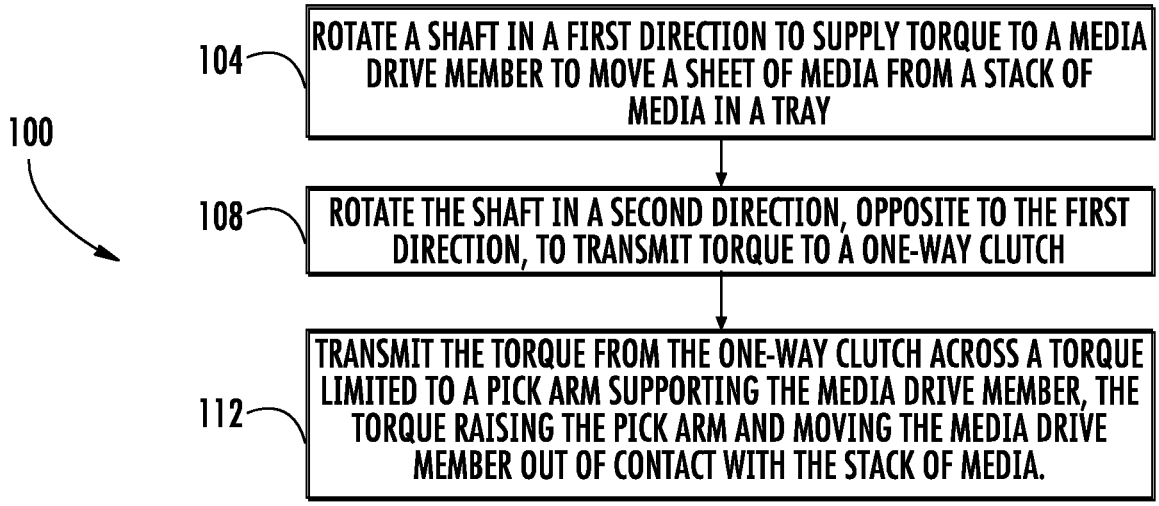
FIG. 2 is a flow diagram of an example method for actuating a pick arm and media drive member between the media engaging and driving position and a raised, media disengaged position.

FIG. 2 is a flow diagram of an example method 100 for actuating a pick arm and media drive member between the media engaging and driving position and a raised, media disengaged position. Although method 100 is described as being carried out with media drive 20 described above, it should be appreciated that method 100 may also be carried out with other media drives, such as any of the media drives described hereafter. As indicated by block 104, shaft 34 is rotated in a first direction so as to supply torque to media drive member 28 to pick and move a sheet of media from a stack of media in media tray 46.

As indicated by block 108, shaft 34 is rotated in a second direction or reverse direction, opposite to the first direction. As a result, one-way clutch 40 automatically engages shaft 34 such that torque is transmitted from shaft 34 to one-way clutch 40. One-way clutch 40 rotates with the rotation of shaft 34 in the second direction.

As indicated by block 112, one-way clutch 40 transmits the torque received from shaft 34, rotating in the second direction, to torque limiter 42. Torque limiter 42 transmits the torque to pick arm 40 which is supporting the media drive member 28. The torque transmitted by torque limiter 42 raises pick arm 30 so as to move media drive member 28 out of contact with the stack of media in media tray 46.

In one implementation, torque limiter 42 continues to transmit torque to pick arm 30 and continues to raise pick arm 30, pivoting pick arm 30 about axis 48, until pick arm 30 encounters a stop or other obstruction. As a result of the pick arm 30 contacting the stop or other obstruction and pick arm 30 no longer being able to be further raised, torque limiter 42 slips. Torque limiter 42 allows the source of torque to continue running with a reduced likelihood of stalling.

Figure 3:
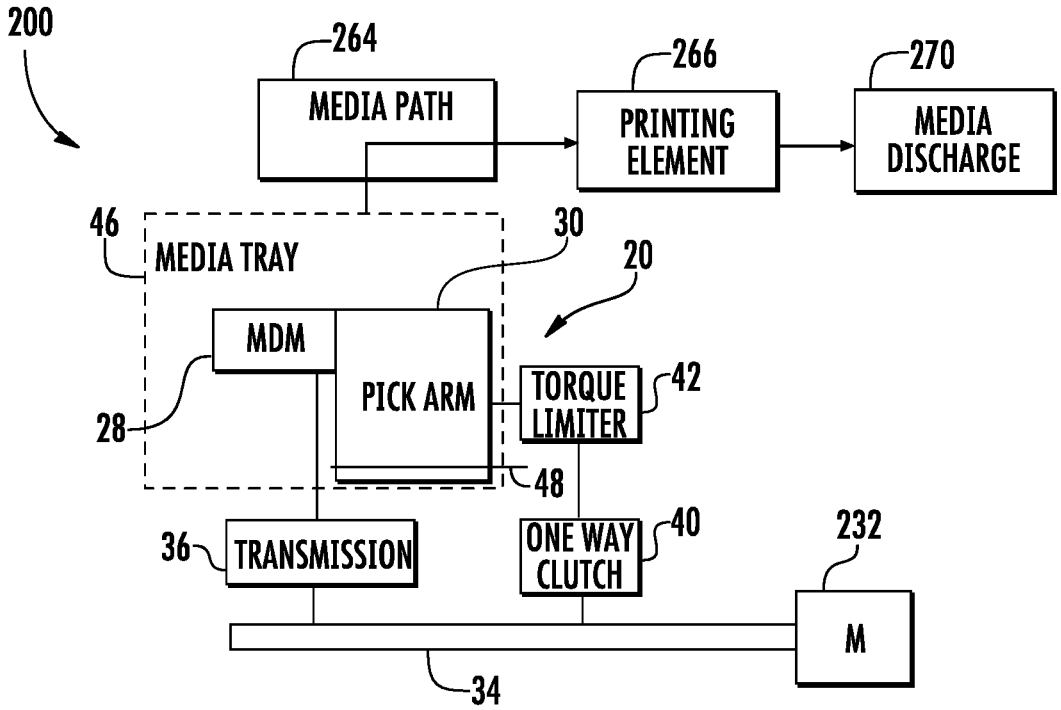
FIG. 3 is a schematic diagram of an example media handling system, shown as an example printer, including the example media drive of FIG. 1.
Figure 4:
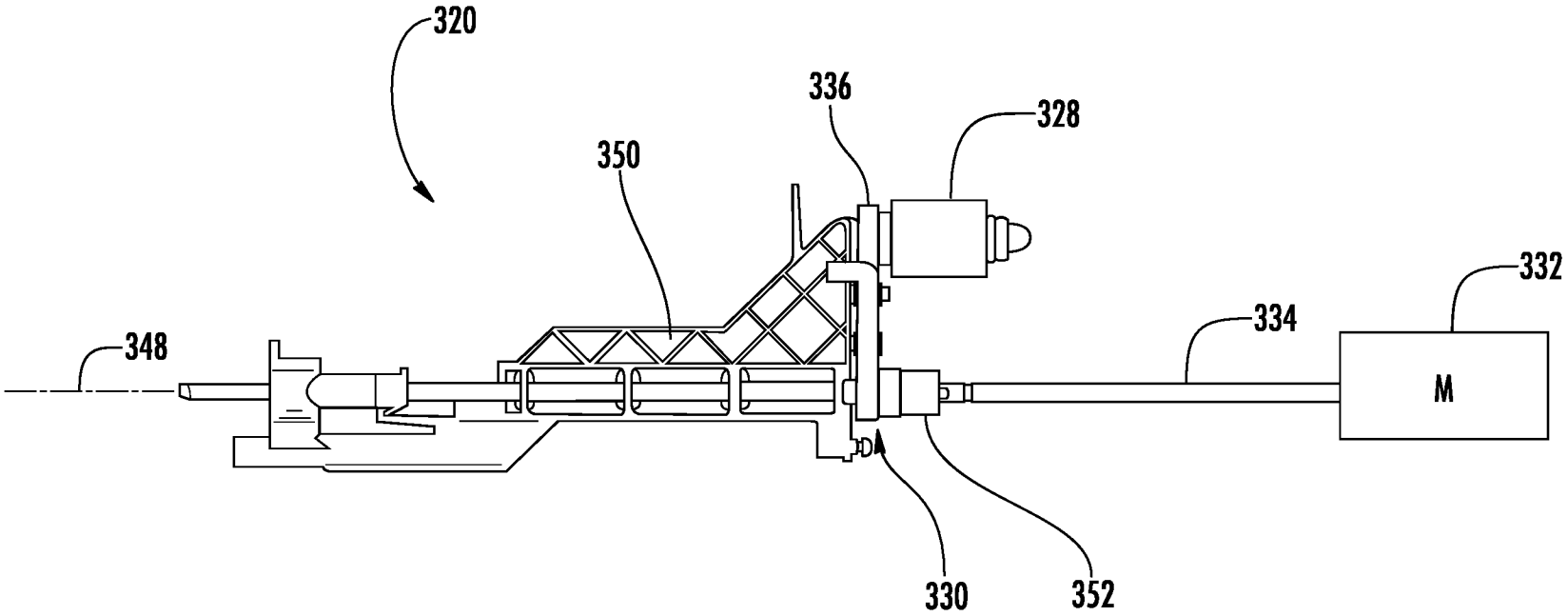
FIG. 4 is a top view of an example media drive.

FIG. 3 schematically illustrates an example media handling device, shown as a printer 200, employing media drive 20. Printer 200 prints upon individual sheets of media from a stack of media contained in media tray 46. In addition to media drive 20, printed 200 comprises media tray 46, motor 232, media path 264, printing element 266 and media discharge 270.

Media tray 46 comprises a tray to contain a stack of individual sheets of media, such as individual sheets of paper. Media tray 46 supports the stack of sheets opposite to media drive member 28 and adjacent to media path 264.

Motor 232 serves as a source of torque for shaft 34. In one implementation, motor 232 comprises a reversible motor operably coupled to shaft 34. In another implementation, motor 232 is operably coupled to shaft 34 by a transmission that facilitates the supply of torque from motor 232 to shaft 34 in two directions. In some implementation, motor 232 additionally drives other components of printer 200, such as components of media path 264.

Media path 264 comprises a media guiding and driving path extending from media tray 46 through the housing or other enclosure of printer 200. Media path 264 may comprise multiple rollers, belts or the like which are rotatably driven by motor 232, or separate motors. Media path 264 directs the individual sheets of media picked and separated by media drive 20 to a media handling element, shown as printing element 266. After the sheet of media has been interacted upon, such as being printed upon, media path 264 may additionally move and transfer the sheet of media from printing element 266 to media discharge 270.

Printing element 266 comprises a device that prints upon one or both faces of the sheet of media provided by media drive 20 and media path 264. In one implementation, printing element 266 comprises one or multiple printheads. In another implementation, printing element 266 comprises a drum or belt and associated dry toner or liquid electrostatic or electrophotography printing components. In yet other implementations, printing element 266 may comprise other presently utilized or future printing technologies. It still other implementations, media handling device 200 may comprise a device to perform operations, other than printing, upon the individually picked and separated sheets of media. For example, in other implementations, media handling device 200 may alternatively comprise scanning, perforating or creasing elements in place of or in addition to printing element 266.

In operation, in response to signals indicating the presence of media within media tray 46 and in response to a print command, motor 232 may be driven to driveshaft 34 in a first direction, supplying torque to media drive member 28 via transmission 36. Media drive member 28 frictionally engages a top or frontmost sheet and drives the separated sheet into media path 264. Media path 264 continues to drive the sheet to printing element 266. Printing element 266 prints upon the sheet of media, wherein media path 264 further transfers the printed upon sheet of media to media discharge 270, such as an output tray. In some implementations, media structure 70 may comprise other devices that also interact or print upon the sheet of media.

In response to signals indicating that media tray 46 is empty, in response to a specific pick arm lift command or in response to a print command no longer being executed, motor 232 may be controlled to drive shaft 34 in a second opposite or reverse direction. As described above, rotation of shaft 34 in the reverse direction results in media drive 20 raising or pivoting pick arm 30 about axis 48 to lift and raise media drive member 28 out of engagement with any media within media tray 46 and further away from the floor of media tray 26. The raising of media drive member 28 facilitates the withdrawal of any existing media from media tray 46 or the loading of new or additional media into tray 46. Once motor 232 is no longer driving shaft 34 in the second or reverse direction, pick arm 30 and media drive member 28 may be allowed to pivot, under the force of gravity or additionally under the force of a bias, such as a spring, back into contact and engagement with the stack of media within media tray 46 or the floor of media tray 46. In some implementations, once motor 232 has discontinued driving shaft 34 in the second direction, pick arm 30 and media drive member 28 remain raised until media drive member 28 once again drives shaft 34 in the first or media picking direction.

FIGS. 4-9 illustrate media drive 320, an example of media drive 20. Media drive 320 picks and separates individual sheets of media and moves such sheets of media out of a media tray for handling by a media handling device. Media drive 320 may be employed in printer 200 described above in place of media drive 20. Media drive 320 may be employed in other printers or other media handling devices. Media drive 320 comprises media drive member 328, pick arm 330, motor 332, shaft, one-way clutch 335 (shown in FIGS. 6 and 7), transmission 336, one-way clutch 340 and torque limiter 342.

Media drive member 328 comprises a member to be driven while in contact with a topmost or front-most sheet of a sheet of media, such as a paper sheet, in media tray 46 (shown in FIG. 1). Media drive member 328 may grip the sheet of paper or frictionally contacted sheet of paper while being driven. To facilitate loading or unloading of media tray 46, media drive member 328 may be lifted or raised out of contact with the stack of media in media tray 46. In the example illustrated, media drive member 328 comprises a pick tire, a tubular or cylindrical member, such as a roller, having a rubber or rubber-like outer circumferential surface that is to be rotatably driven in at least one direction while in contact with media. In another implementation, media drive member 328 may comprise a belt or other media gripping surface which is driven or rotated about multiple axes while in contact with the media.

Pick arm 330 comprises a structure that movably supports media drive member 328 relative to the media within media tray 46. Pick arm 330 pivotably supports media drive member 28 for movement between the media engaging and driving position and a media disengaged position. Pick arm 330 is pivotally supported by housing, frame or other structure about shaft 334 and about axis 348.

In the example illustrated, pick arm 330 comprises a multi-piece construction comprising transmission supporting portion 350 and transmission shielding portion 352. Transmission supporting portion 350 is pivotally positioned and supported by shaft 334 while supporting transmission 336. Shielding portion 352 is fixedly connected to portion 350 while being pivotably supported by shaft 336. Shielding portion 352 extends over and about transmission 336 as well as one-way clutch 340 and torque limiter 342. In the example illustrated, shielding portion 352 is directly connected to torque limiter 342. In other implementations, other portions of pick arm 330 may be directly connected to torque limiter 342. In other implementations, pick arm 330 may comprise a single piece or may comprise alternative constructions.

Motor 332 serves as a source of torque for shaft 334. In one implementation, motor 332 comprises a reversible motor operably coupled to shaft 34. In another implementation, motor 332 is operably coupled to shaft 334 by a transmission that facilitates the supply of torque from motor 332 to shaft 334 in two directions. In some implementation, motor 332 additionally drives other components of the media handling device employing drive 320.

Shaft 334 comprises a shaft operably coupled to motor 332 so as to be rotatably driven and so as to transmit torque to transmission 336 and to one-way clutch 340, depending upon the direction of rotation of shaft 334. Shaft 334 is rotatably supported by housing or other structure of the media handling device employing media drive 320. In the example illustrated, shaft 334 extends through and rotatably supports one-way clutch 340 and torque limiter 342. As a result, drive 320 may be more compact. In other implementations, shaft 334 may extend through one of one-way clutch 340 and torque limiter 342 or may be offset from one-way clutch 340 and torque limiter 342, wherein one-way clutch 340 and torque from 342 are rotatably supported about separate axes.

Figure 6:
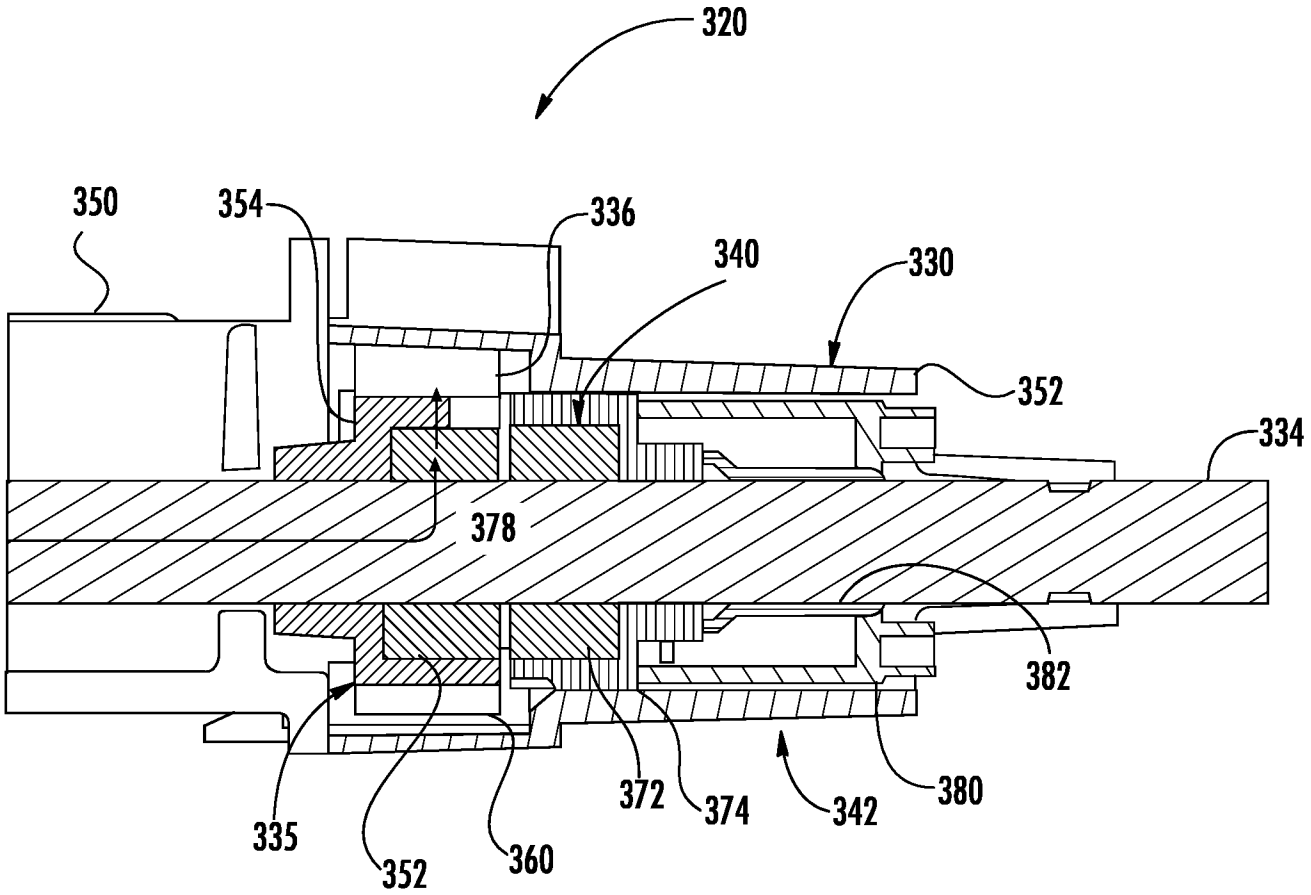
FIG. 6 is a sectional view of the example media drive of FIG. 5 taken along line 6-6, illustrating the media drive in a media picking state.

As shown by FIG. 6, one-way clutch 335 is operably coupled between shaft 334 and transmission 336. One-way clutch 335 transmits torque to transmission 336 in response to shaft 334 being rotatably driven in a first, forward or picking direction. One-way clutch 335 automatically disconnects shaft 334 and transmission 336 in response to shaft 334 being driven in a second reverse direction, such as during the lifting of media drive member 328 and pick arm 330.

In the example illustrated, one-way clutch 335 comprises a first shaft portion 352 and a second transmission portion 354. Shaft portion 352 is fixed to shaft 334 to rotate with shaft 334. Transmission portion 354 is fixed to drive gear 360 of transmission 336. Portion 352 and 354 interlock to one another in response to shaft 334 being driven in the first, forward or picking direction. Portions 352 and 354 disconnect or disengage one another automatically in response to shaft 334 being driven in the second reverse direction. In one implementation, one-way clutch 335 comprises a needle bearing one-way clutch. In other implementations, one-way clutch 335 may comprise other mechanisms or may be omitted.

Figure 5:
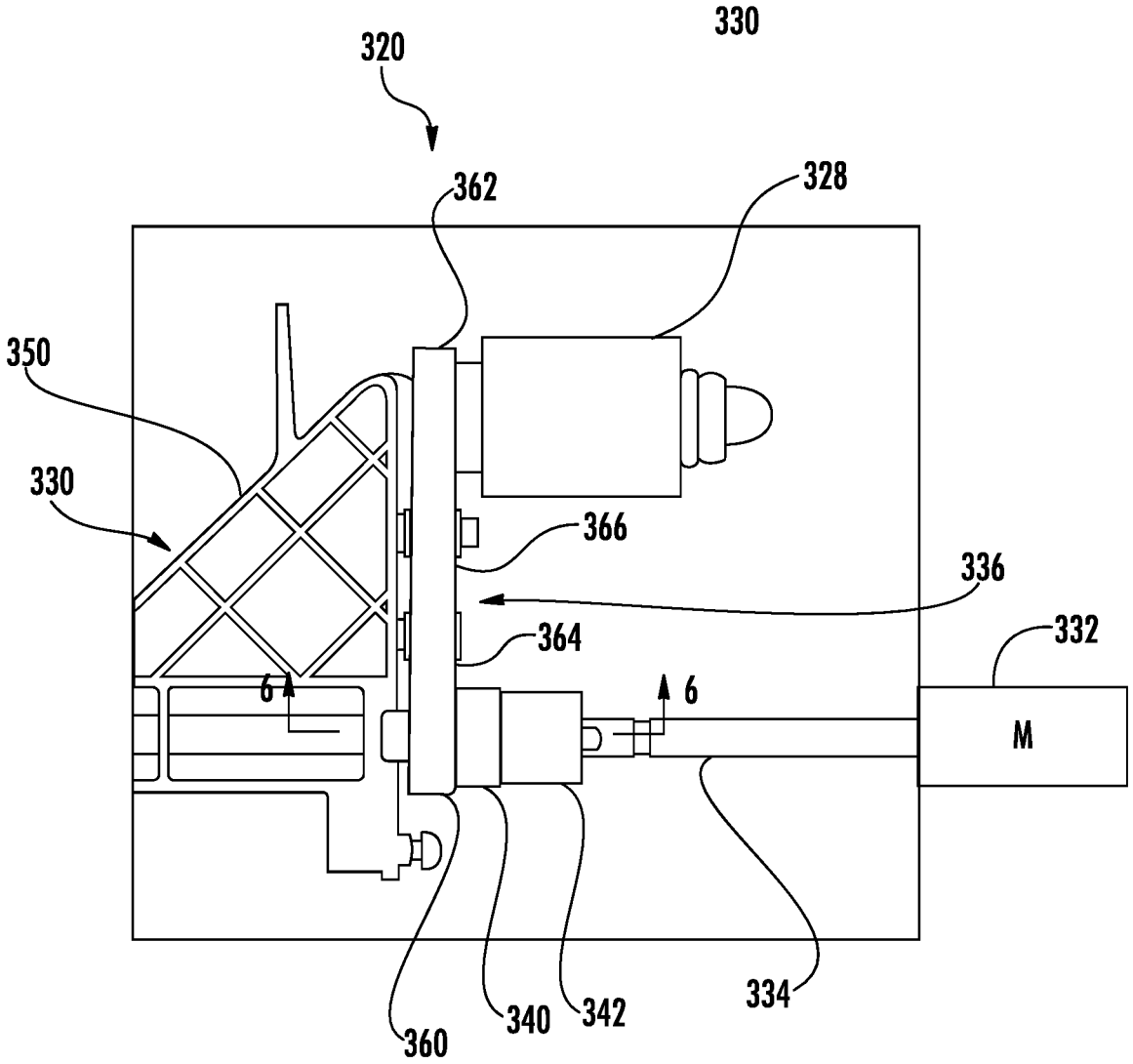
FIG. 5 is an enlarged fragmentary view of a portion of the media drive of FIG. 4.

Transmission 336 comprises a drivetrain or powertrain by which torque from shaft 334 is transmitted to media drive member 328 to drive a rotate media drive member 328. In the example illustrated, transmission 336 comprises a gear train supported by transmission supporting portion 350 of pick arm 330. In the example illustrated, as shown by FIG. 5, transmission 336 comprises drive gear 360, driven gear 362 and idler gears 364, 366. As shown by FIG. 6, drive gear 360 comprises a cylindrical gear, such as a spur gear or helical gear, fixed to one-way clutch 335 so as to be driven in the in response to shaft 330 for being driven in the first forward or picking direction. Drive gear 360 is in meshing engagement with idler cylindrical gear 364 which is in meshing engagement with idler cylindrical gear 366.

Driven gear 362 comprises a cylindrical gear rotatably supported by portion 350 of pick arm 330 and connected to the pick tire of media drive member 328. In the example illustrated, driven gear 362 is directly connected to media drive member 328. In other implementations, driven gear 362 may be operably coupled to media drive 328 by additional gears or by a one-way clutch and/or torque limiter that facilitate rotation of media drive member 328 in an opposite direction, such as when media is being pulled from the media tray while media drive member 328 is in a down, media engaging position.

One-way clutch 340 and torque limiter 342 cooperate to form a lift mechanism to raise pick arm 330 and media drive member 328 from a media driving and engaging state or position to a media disengaged state or position. One-way clutch 340 comprises a clutch mechanism coupled to shaft 334 that automatically actuates between a shaft engaged and a shaft disengaged state depending upon the direction in which shaft 334 is being rotatably driven. One-way clutch 340 is operably disengaged from shaft 334 in response to shaft 334 rotating in a first forward or media picking direction that drives media drive member 328 in a driven direction that moves the engaged sheet of media towards and further along the media path. One-way clutch 430 automatically engages shaft 334 so as to rotate with shaft 334, in response to shaft 334 being rotated in a second reverse direction.

In the example illustrated, one-way clutch 340 comprises a first shaft portion 372 and a second torque limiter portion 374. Shaft portion 372 is fixed to shaft 334 to rotate with shaft 334. Torque limiter portion 374 is fixed to torque limiter 342. Portions 372 and 374 interlock to one another in response to shaft 334 being driven in the second reverse direction. Portions 372 and 374 disconnect or disengage one another automatically in response to shaft 334 being driven in the first forward or picking direction. In one implementation, one-way clutch 340 comprises a needle bearing one-way clutch. In other implementations, one-way clutch 340 may comprise other unidirectional clutching or ratcheting mechanisms.

Torque limiter 342 comprises a mechanism that limits the amount of torque, the magnitude of torque, being transmitted. Torque limiter 342 is operably coupled between one-way clutch 340 and pick arm 330. In one implementation, torque limiter 342 limits torque by slipping, as in a friction plate slip-clutch. In one implementation, torque limiter 342 comprises a first pick arm portion 380 fixed or directly connected to pick arm 330 and a second one-way clutch portion 382 fixed or otherwise directly connected to portion 374 of one-way clutch 340, wherein the two portions 380 and 382 are in frictional contact with one another so as to move with one another (without slippage) and transmit torque there between or so as to slip relative to one another, reducing or completely discontinuing the amount of torque being transmitted between the two portions. In the example illustrated, torque limiter 342 transmits torque (without slipping) from one-way clutch 340 to pick arm 330 while pick arm 330 is being raised and is moving. Torque limiter 342 slips or discontinues the transmission of torque from one-way clutch 340 to pick arm 330 automatically in response to pick arm 330 encountering an obstruction or stop that limits any further upwards movement or upward pivoting of pick arm 330. Torque limiter 342 allows motor 332 to continue running into continue to supply torque to shaft 334 without stalling after pick arm 330 hits its rotation stop.

Figure 7:
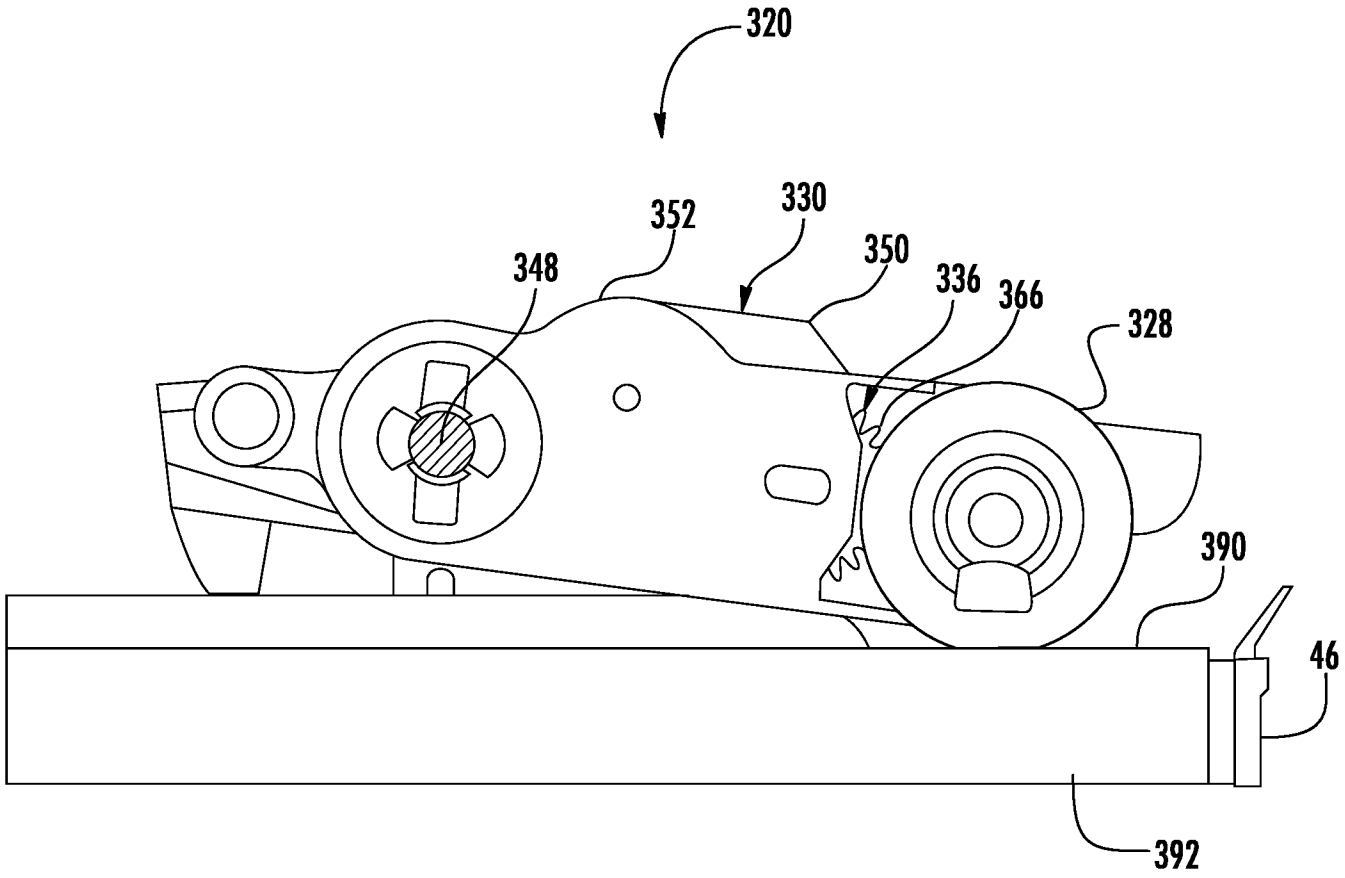
FIG. 7 is a side elevational view of the media drive in the media picking state.

FIGS. 6-9 illustrate operation of media drive 320. FIGS. 6 and 7 illustrate media drive 320 in a media driving or picking state. In the media driving or picking state, pick arm 330 is lowered (as shown 7) such that media drive member 328 is in contact with the topmost sheet 390 of the stack 392 of sheets within media tray 46. In response to a print command or other media handling command, motor 332 drives shaft 334 in the first forward or picking direction. In response to shaft 334 being driven in the first forward or picking direction, as indicated by arrows 378, one-way clutch 335 automatically connects shaft 334 to transmission 336. Transmission 336 transmits torque from shaft 334 with drive gear 360, across idler gears 364, 366 and to driven gear 362 which drives media drive member 328 in a direction so as to move the engaged sheet of media into the media path. Such transmission of torque may further assist in driving pick arm 330 and media drive member 328 downward towards a stack of media.

Figure 8:
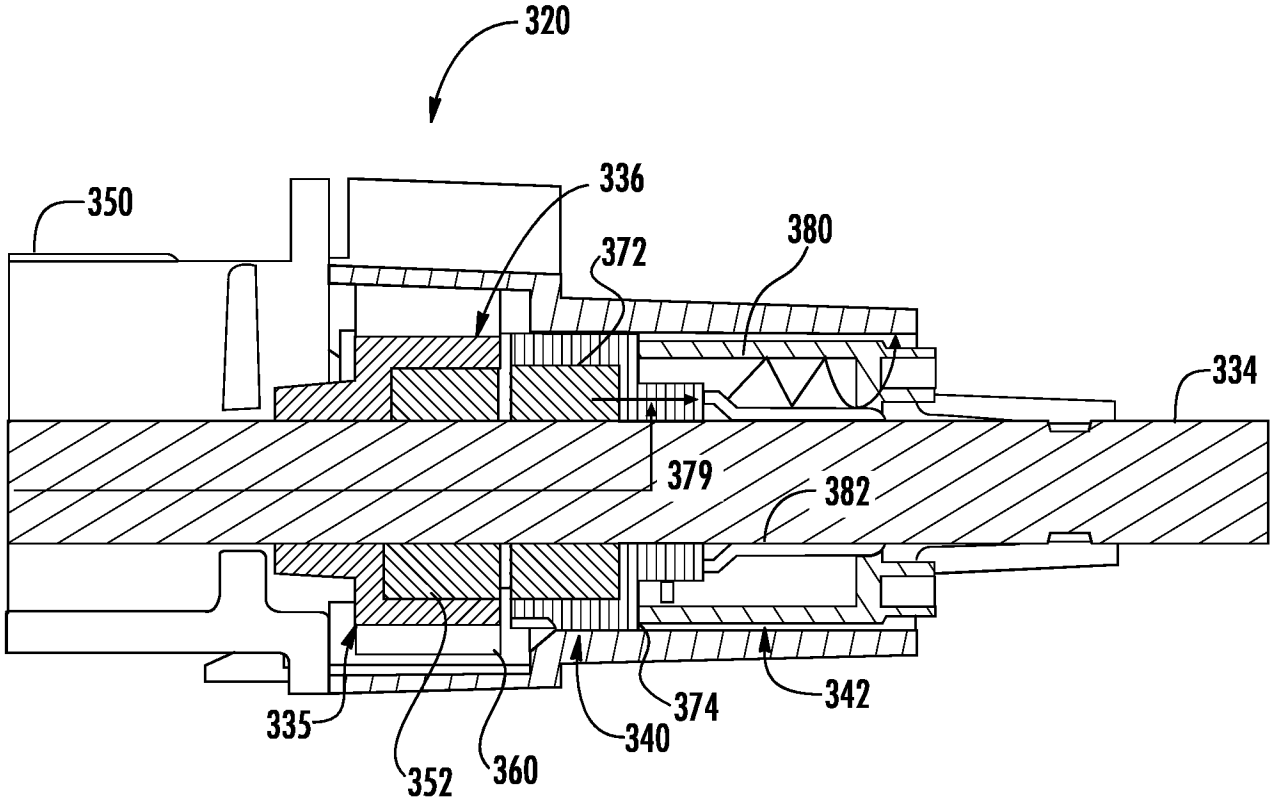
FIG. 8 is a sectional view of the example media drive of The 5 taken along line 6-6, illustrating the media drive of FIG. 7 in a raised pick arm state.
Figure 9:
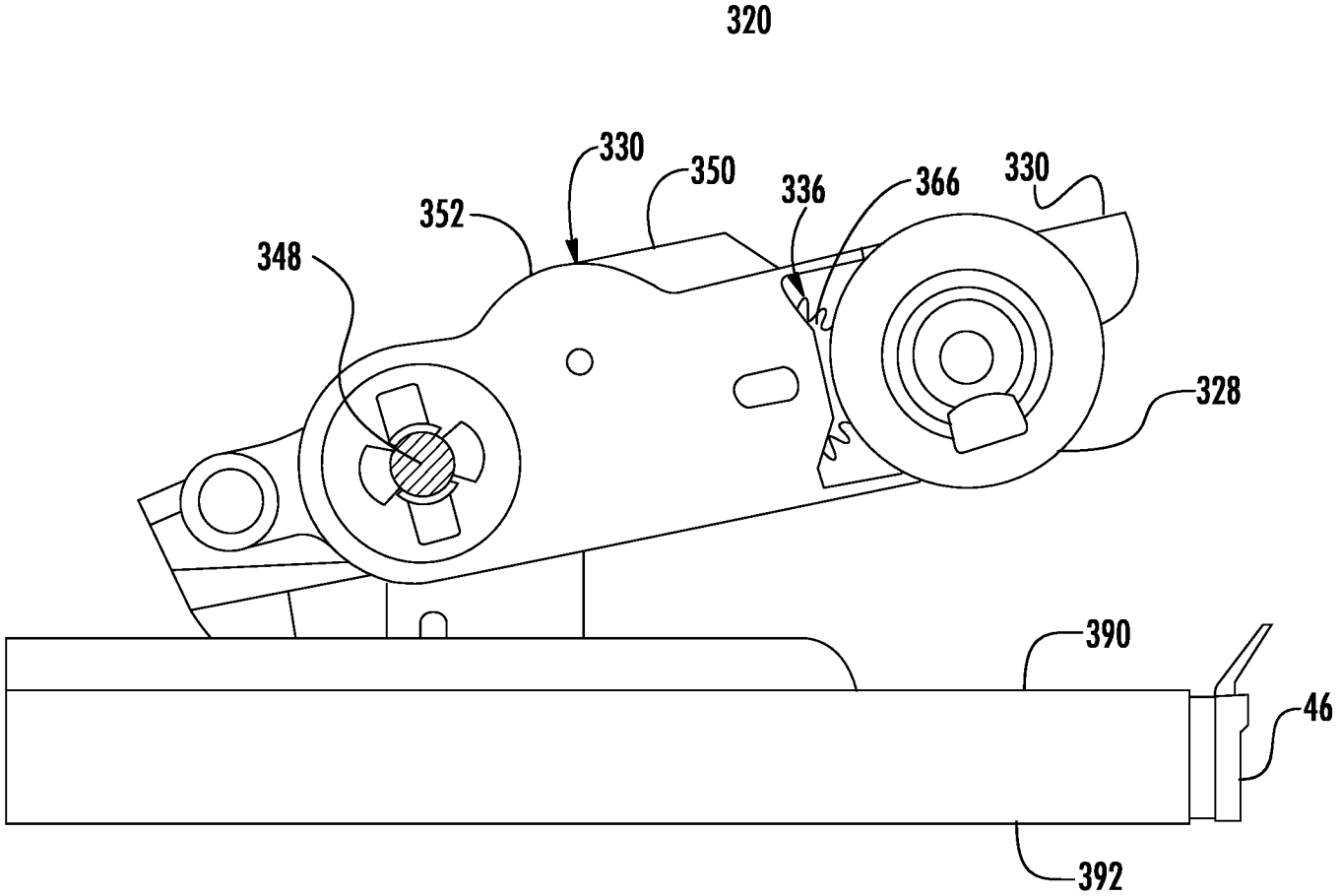
FIG. 9 is a side elevational view of the media drive of FIG. 8 in the raised pick arm state.

FIGS. 8 and 9 illustrate the raising and lifting of pick arm 330 and media drive member 328 in response to shaft 334 being driven in a reverse direction. In the pick arm raising state, which may occur in response signals indicating that media tray 46 is empty, in response to a specific pick arm lift command or in response to a print command no longer being executed, motor 332 may be controlled to drive shaft 334 in a second opposite or reverse direction. As a result, one-way clutch 335 automatically disconnects transmission 336 from shaft 334. At the same time, one-way clutch 340 automatically connects shaft 334 to torque limiter 342. As indicated by arrows 379 in FIG. 8, torque is transferred from shaft 334 to torque limiter 342. Torque limiter 342 transfers torque through a friction connection with pick arm 330, resulting in lift arm 330 and media drive member 328 being pivoted about axis 348 as shown in FIG. 9. The friction connection allows slip, permitting shaft 334 to continue turning after pick arm 330 is rotated to its upper stop.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A media drive comprising:

a media drive member;

a shaft;

a pick arm rotationally supporting the media drive member;

a transmission operably coupling the shaft and the media drive member such that rotation of the shaft in a first direction drives the media drive member;

a one-way clutch coupled to the shaft to be operably disengaged from the shaft in response to the shaft rotating in the first direction, wherein the one-way clutch is to rotate with the shaft in response to the shaft being rotated in a second direction opposite the first direction; and a torque limiter connected to the one-way clutch to rotate with the one-way clutch, the torque limiter being coupled to the pick arm to raise the pick arm and the media drive member in response to the shaft being rotated in the second direction, wherein the shaft coaxially supports the one-way clutch within the torque limiter.

2. The media drive of claim 1, wherein the shaft extends through the one-way clutch and the torque limiter.

3. The media drive of claim 2 further comprising a second one-way clutch operably coupled between the shaft and the transmission, the second one-way clutch to operably connect the shaft and the transmission in response to the shaft being rotated in the second direction and to operably disconnect the shaft and the transmission in response to the shaft being rotated in the first direction.

4. The media drive of claim 1 further comprising a second one-way clutch operably coupled between the shaft and the transmission, the second one-way clutch to operably connect the shaft and the transmission in response to the shaft being rotated in the second direction and to operably disconnect the shaft and the transmission in response to the shaft being rotated in the first direction.

5. The media drive of claim 1, wherein the media drive member comprises a pick tire.

6. The media drive of claim 1, wherein the arm carries the transmission and wherein the shaft pivotably supports the arm.

7. The media drive of claim 1 further comprising a reversible motor connected to the shaft.

8. The media drive of claim 1, wherein the media drive member has a first length extending in a direction parallel to the shaft and wherein the one-way clutch and the torque limiter have a combined length extending in the direction parallel to the shaft and less than the first length.

9. A printer comprising:

a media tray to contain a stack of sheets of print media;

a media path extending from the media tray, across printing elements to a media discharge; and a media drive to pick individual sheets of the stack of sheets for transfer along the media path, the media drive comprising:

a media drive member;

a shaft;

a pick arm rotationally supporting the media drive member;

a transmission operably coupling the shaft and the media drive member such that rotation of the shaft in a first direction drives the media drive member;

a one-way clutch coupled to the shaft to be operably disengaged from the shaft in response to the shaft rotating in the first direction, wherein the one-way clutch is to rotate with the shaft in response to the shaft being rotated in a second direction opposite the first direction; and a torque limiter connected to the one-way clutch to rotate with the one-way clutch, the torque limiter being coupled to the pick arm to raise the pick arm and the media drive member in response to the shaft being rotated in the second direction, wherein the shaft coaxially supports the one-way clutch within the torque limiter.

10. The printer of claim 9, wherein the shaft extends through the one-way clutch and the torque limiter.

11. The printer claim 9 further comprising a second one-way clutch operably coupled between the shaft and the transmission, the second one-way clutch to operably connect the shaft and the transmission in response to the shaft being rotated in the second direction and to operably disconnect the shaft and the transmission in response to the shaft being rotated in the first direction.

12. The printer of claim 9, wherein the media drive member comprises a pick tire.

13. The printer of claim 9, wherein the media drive member has a first length extending in a direction parallel to the shaft and wherein the one-way clutch and the torque limiter have a combined length extending in the direction parallel to the shaft and less than the first length.

14. A method comprising:

coaxially supporting a one-way clutch in a torque limiter on a shaft;

rotating the shaft in a first direction to supply torque to a media drive member to move a sheet of media from a stack of media in a tray;

rotating the shaft in a second direction, opposite to the first direction, to transmit torque to the one-way clutch; and transmitting the torque from the one-way clutch across the torque limiter to a pick arm supporting the media drive member, the torque raising the pick arm and moving the media drive member out of contact with the stack of media.

15. The method of claim 14, wherein the torque is transmitted by a transmission, the method further comprising:

in response to the shaft being rotated in the first direction, operably disconnecting, by the second one-way clutch, the transmission from the shaft; and in response to the shaft being rotated in the second direction, operably connecting, by the second one-way clutch, a transmission to the shaft.

* * * * *